US005915156A

United States Patent [19]

Kizaki et al.

[11] Patent Number: 5,915,156

[45] Date of Patent: Jun. 22, 1999

[54] IMAGE FORMING APPARATUS WITH CLEANING BLADE AND ENHANCED LUBRICATION OPERATION

[75] Inventors: Osamu Kizaki; Atsushi Sanpe, both of Tokyo, Japan

[73] Assignee: Ricoh Company, Ltd., Tokyo, Japan

[21] Appl. No.: 08/991,859

[22] Filed: Dec. 16, 1997

[30] Foreign Application Priority Data

Dec. 16, 1996 [JP] Japan ..... 8-353664

[51] Int. Cl.[6] ..... G03G 21/00

[52] U.S. Cl. ..... 399/346; 399/350

[58] Field of Search ..... 399/346, 71, 350

[56] References Cited

U.S. PATENT DOCUMENTS

| | | | |
|---|---|---|---|
| 4,519,698 | 5/1985 | Kohyama et al. | 399/346 |
| 4,557,588 | 12/1985 | Tomosada | 399/71 X |
| 4,969,015 | 11/1990 | Sanpe . | |
| 5,349,429 | 9/1994 | Jugle et al. | 399/346 |
| 5,386,274 | 1/1995 | Sanpe et al. . | |
| 5,663,788 | 9/1997 | Sanpe . | |
| 5,812,919 | 9/1998 | Takano et al. | 399/346 X |

FOREIGN PATENT DOCUMENTS

| | | |
|---|---|---|
| 60-8887 | 1/1985 | Japan . |
| 60-118172 | 8/1985 | Japan . |
| 60-194484 | 10/1985 | Japan . |
| 61-51185 | 3/1986 | Japan . |
| 61-94083 | 5/1986 | Japan . |
| 61-95381 | 5/1986 | Japan . |
| 62-131283 | 6/1987 | Japan . |
| 63-49782 | 3/1988 | Japan . |
| 63-95488 | 4/1988 | Japan . |
| 64-59287 | 3/1989 | Japan . |
| 64-59376 | 3/1989 | Japan . |
| 1-108592 | 4/1989 | Japan . |
| 5-40438 | 2/1993 | Japan . |
| 6-194917 | 7/1994 | Japan . |
| 8-006441 | 1/1996 | Japan . |

*Primary Examiner*—S. Lee

*Attorney, Agent, or Firm*—Oblon, Spivak, McClelland, Maier & Neustadt, P.C.

[57] ABSTRACT

A contact time with an image carrier and a cleaning blade is added up, and a toner image pattern is formed according to such an added up value. Accordingly, the quantity of toner as a lubricant sticking based on a toner image pattern becomes a most suitable quantity. As the added up value increases when it is described concretely, an area of the toner image pattern is made small, and accordingly a quantity of adhesion of toner is reduced. Accordingly, when a frictional resistance between an image carrier and a cleaning blade becomes low, or when an image carrier deteriorates, a quantity of supply of toner is controlled to be a proper amount

12 Claims, 10 Drawing Sheets

IMAGE FORMING APPARATUS WITH CLEANING BLADE AND ENHANCED LUBRICATION OPERATION

CROSS-REFERENCE TO RELATED APPLICATIONS

This application contains subject matter related to application Ser. No. 93-125,306, filed Sep. 23, 1993, now U.S. Pat. No. 5,386,274; application Ser. No. 89-451,992, filed Dec. 18, 1989, now U.S. Pat. No. 4,969,015; application Ser. No. 93-42018, filed Apr. 2, 1993, now U.S. Pat. No. 5,663,788; all of which are incorporated herein by reference.

BACKGROUND OF THE INVENTION

1. Field of the Invention

The present invention relates to an image forming device, e.g. a copier, facsimile, printer, that includes a cleaning blade to sweep away toner left on an image carrier. More particularly, the present invention relates to a device which supplies lubricant to a contact portion between the cleaning blade and the image carrier in order to reduce friction between the cleaning blade and image carrier.

2. Discussion of the Background

An image forming apparatus, such as an electrostatic copying machine, printer, facsimile, etc., that employs an electrophotography process may include a cleaning device for sweeping away toner left on an image carrier. A conventional cleaning device includes a cleaning blade which contacts an image carrier in a counter direction of a rotation direction of the image carrier. To prevent the blade from causing vibration at an early stage, a setting powder can be put onto the surface of the image carrier and the cleaning blade to reduce the friction between them. For example, polyvinylidene fluoride resin can be used as such a setting powder.

Utilizing a setting powder as a lubricant does not provide a large lubrication effect if not enough setting powder is put on the surface of the image carrier or the cleaning blade. However, a cleaning defectiveness resulting from cohesion of lubricant may arise when too much setting powder is used.

In particular, when utilizing a contact-type charging member, such as a charging roller, for uniformly charging an image carrier with electricity, setting powder may fall off from the cleaning blade with a downstream side of movement of the image carrier relative to the cleaning blade when there is too much setting powder put on the image carrier. As a result, the setting powder may adhere to the charging member and an image defect may occur. On this account, as for a desired quantity of application of the setting powder, a small amount is desirable if possible. However, if only a small amount of setting powder is used there is a concern that the cleaning blade will become wound up, especially in an early stage. Therefore, to prevent the cleaning blade from being wound and chipped, and to prevent an image defect from occurring as a result of a sliding friction between the cleaning blade and the image carrier from an inadequate application of the setting powder, a technology is known in which an image pattern is formed and is used to determine supplying toner as a lubricant. In this operation the toner is conveyed where the cleaning blade comes in contact with the photosensitive drum, and the toner, acting as a lubricant, is supplied to a contact portion of the cleaning blade and the image carrier forcibly. In this technology, the toner is supplied to the contact portion surely. This technology is disclosed, for example, in Japanese Laid-Open Patent Application No. 1-108592, Japanese Laid-Open Patent Application No. 6-194917, and Japanese Laid-Open Utility Model Application No. 60-118172.

However, as for this technology, the application toner, as a lubricant, supplied on the image carrier may increase or accumulate with years of use. Therefore, a drawback of toner scattering may arise. As a result of researching this drawback by the present inventors, a relationship of abrasion between the image carrier and the cleaning blade was found.

An ability of a surface of the image carrier is good in a state of use at an early stage of an image forming apparatus, and thus a coefficient of friction between the image carrier and the cleaning blade is significantly changed by the presence or the amount of supply of lubricant. Accordingly, the cleaning blade can be easily wound up by an opportunity of the few.

On the other hand, as the surface of the image carrier and the surface of the cleaning blade are polished by toner or by each other, the cleaning blade becomes comfortable with the image carrier, and the coefficient of friction between the cleaning blade and image carrier decreases with aged deterioration. Accordingly, the cleaning blade is hard to become rolled up. For this reason, it becomes necessary to supply only a small quantity lubricant, such as toner, to the contact portion of the image carrier and cleaning blade over time.

A thickness of a surface layer of the image carrier (photosensitive layer) decreases with wearing, and a sensitivity of the image carrier also deteriorates. Accordingly, when a toner image pattern for toner concentration control is formed on the image carrier, and toner supplying to a developer is controlled based on a quantity of toner adhesion to the toner image pattern, even if the toner concentration in the developer is at a fixed density, the developing density of the toner image pattern falls, and the toner is replenished in a surplus amount in the developer by the fall of sensitivity of the image carrier, and toner scattering may then easily occur.

Furthermore, because of age deterioration of toner charging ability due to deterioration of a developing agent, toner scattering may increase. In this way, over time too much lubricant, such as toner, may be supplied to a contact portion between the image carrier and the cleaning blade in order to prevent the cleaning blade from being wound up, and even further, a problem may arise that the toner excess becomes scattered at both ends in a long distance direction of the cleaning blade, and then the toner may stick to the image carrier.

Recently, a contact-type transcription member, such as a transcription belt or transcription roller, has been adopted for the propose of ozone reduction. When toner scattering occurs in an image forming apparatus utilizing a contact type transcription member, because the scattering toner is transferred directly to the transfer, member there is the concern that detrimental effects such as filming of the transfer member or pollution in the image forming apparatus may occur.

SUMMARY OF THE INVENTION

Accordingly, one object of the present invention is to provide a novel image forming apparatus with a cleaning device that overcomes the above-mentioned limitations of existing systems.

Another object of the present invention is to provide a novel image forming apparatus which can maintain a surface ability of an image carrier for a long period of time.

Yet another object of the present invention is to provide a novel image forming apparatus which can reduce toner scattering as a lubricant with a reduction of a coefficient of friction between an image carrier and a cleaning blade.

Still another object of the present invention is to provide a novel image forming apparatus including a controller which can control supplying a proper quantity of lubricant to a contact portion between an image carrier and a cleaning blade on the basis of an attaching status of the cleaning blade and the image carrier.

According to one feature of the invention, the above and other objects are achieved by providing an image forming apparatus having an image carrier, a cleaning device for contacting the image carrier, a lubricant supplying device for supplying lubricant to a contact portion between the cleaning blade and the image carrier, a calculating device for adding up a driving condition of the image carrier, and a controller for regulating the supplying quantity of the lubricant by the lubricant supplying device based on the result of a sum added up by the calculating device.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
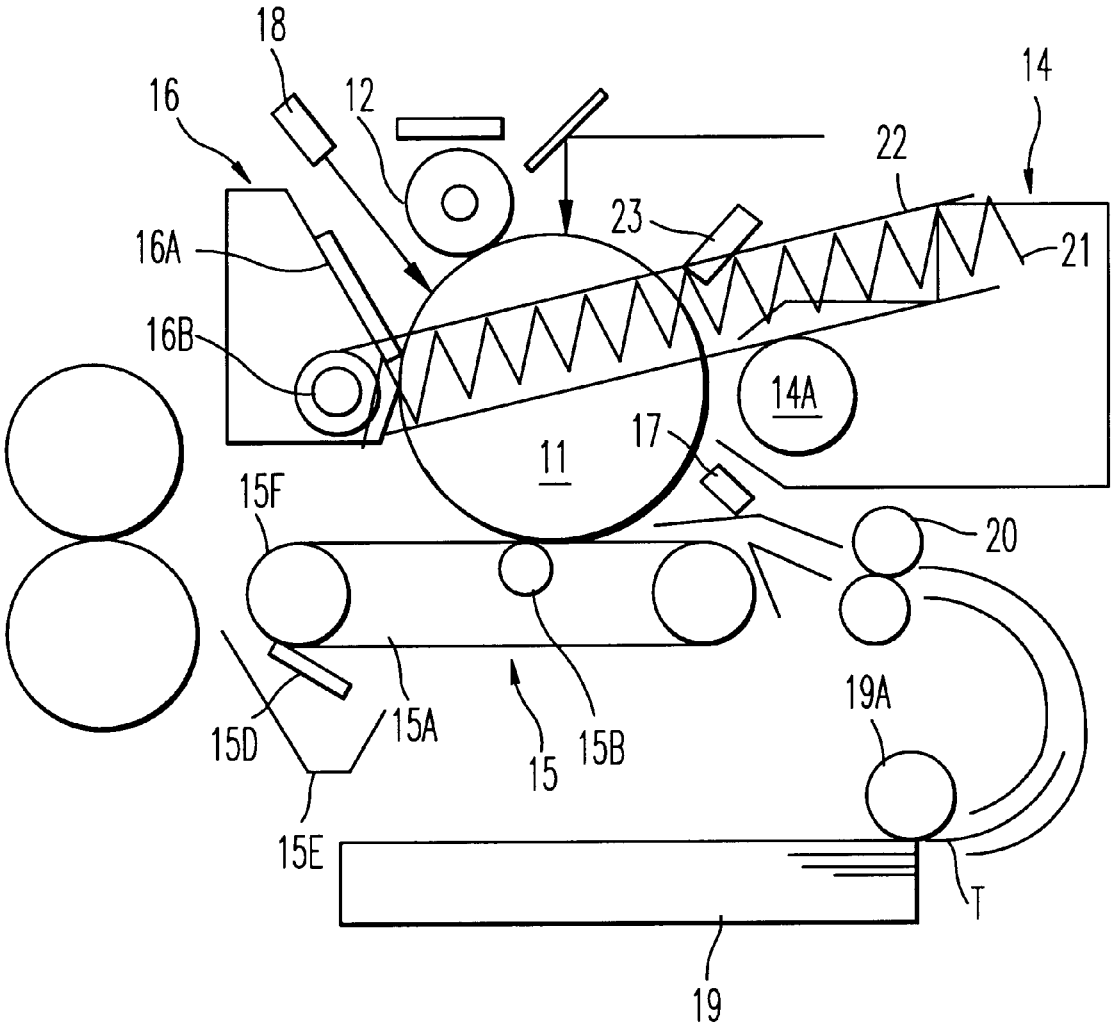
FIG. 1 shows an outline construction of an image forming device according to an embodiment of the present invention.

Referring now to the drawings, wherein like reference numerals designate identical or corresponding parts throughout the several views, and more particularly to FIG. 1 thereof, an image forming device that includes a cleaning device of the present invention is shown.

In FIG. 1 the image forming device includes a photosensitive drum 11 that functions as an image carrier, a charging roller 12 contacting the photosensitive drum 11 that functions as a charger, a developer 14 for developing an electrical latent image on the photosensitive drum 11, a transfer device 15 for transferring a toner image on the photosensitive drum 11 to a transfer paper T, and a cleaning unit 16 including a cleaning blade 16A contacting the photosensitive drum 11 for cleaning residual toner from the photosensitive drum 11.

The photosensitive drum 11 has a photoconductive layer, such as an OPC, on an outer surface, and the photosensitive drum 11 rotates clockwise as shown in FIG. 1. As for charging roller 12, a high-pressure voltage is generated in a copying movement, and as a result the outer surface of the photosensitive drum 11 becomes uniformly charged, e.g., negatively charged.

The contents of an original document irradiated by a halogen lamp and reflected by mirrors is then focused onto the photosensitive drum 11. The negative charge on the photosensitive drum 11 becomes selectively extinct from the intensity of the light of the focused contents, and an electrical latent image is thereby formed on the photosensitive drum 11. Furthermore, a discharge lamp 23 illuminates an area not necessary for the copying process, and which is usually bigger than a transfer paper, among the electrical latent image, and the negative charge at this illuminated area also becomes extinct.

Toner is accommodated inside the developer 14, and by a rotation of a developing sleeve 14A, the toner is supplied to the surface of the photosensitive drum 11, and the electrical latent image formed on the photosensitive drum 11 is developed into a visible image. A toner image on the photosensitive drum 11 is then conveyed to a transcription position of the transfer device 15 by a rotation of the photosensitive drum 11. In advance of this transcription, to increase efficiency of the transcription, an electrical charge on the surface of the photosensitive drum 11 is removed by a PLT 17, and a transcription paper T conveyed by feeding roller 19 from a paper unit 19 and via a resist roller 20 is fed by the resist roller 20 with a proper timing with respect to the image on the photosensitive drum 11.

A bias roller 15B applies a transcription bias voltage at a same time that a tip of the transfer paper T reaches a nipping position between the transfer belt 15A, which is an element of the transfer device 15, and the photosensitive drum 11, and a charge of reverse polarity of the toner image on the photosensitive drum 11 is generated by the bias roller 15B. Consequently, the toner image is transferred to the transfer paper T. A cleaning blade 15D, e.g., made of gum such as polyurethane gum, is arranged at a side where a drive roller 15F of the transfer belt 15A is arranged, in contact with the photosensitive drum 11. The surface of the transfer belt 15A may have a fluorine base resin coat. Consequently, a coefficient of friction $\mu$ for the cleaning blade 15D is suppressed to be properly low. An alien substance, such as paper powder or residual toner, on the transfer belt 15A is removed by the cleaning blade 15D and is stored in a container 15E located underneath the cleaning blade 15D.

On the other hand, residual toner remaining on the photosensitive drum 11 is removed by a cleaning blade 16A of the cleaning device 16 without being transferred to the transfer paper T, and is collected with the spiral member 16B and conveyed up to the developer 14 by a conveyance coil 21 through a conveyance pipe 22 and is recycled. Then, the photosensitive drum 11 is exposed to light by a quenching lamp (QL) 18, and a residual charge is erased, and the image forming device then prepares for a next copy operation.

Figure 2:
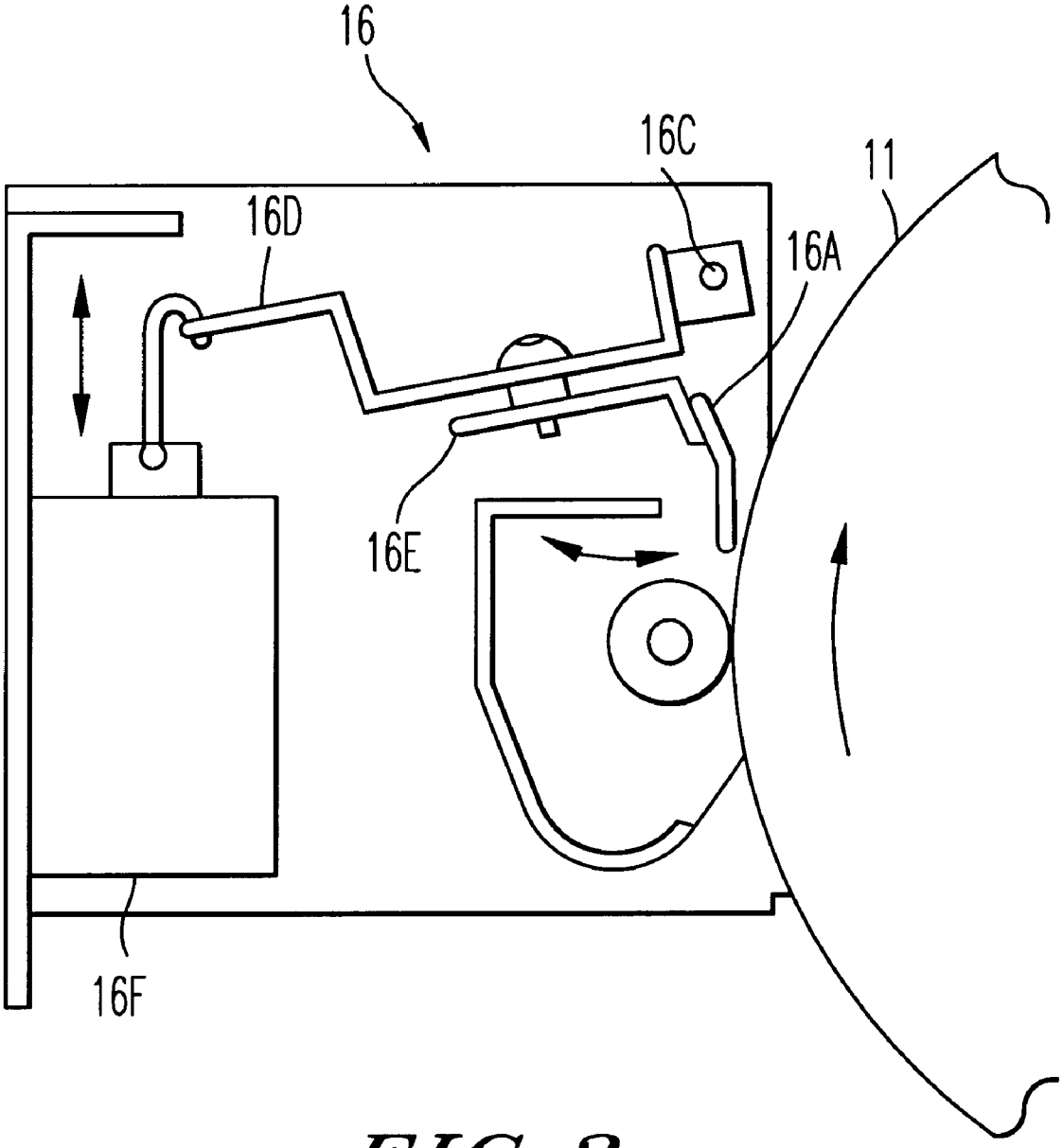
FIG. 2 shows an outline construction of a cleaning device according to an embodiment of the present invention.

In this embodiment, the cleaning blade 16A normally comes in contact with the photosensitive drum 11. However, as shown in FIG. 2 showing a further embodiment according to this invention, it is acceptable to add a blade moving device that moves the cleaning blade 16A away from the contact portion with the photosensitive drum 11 provisionally. In FIG. 2, the blade moving device includes a swing plate 16D rotating about a supporting shaft 16C. The plate 16D and a plate 16E connecting with the cleaning blade 16A are secured by a screw 16E. Furthermore, a solenoid 16F is connected to an end of an opposite side of the swing plate 16D in regard to the supporting shaft 16C, and the plate 16D turns based on an ON/FF action of the solenoid 16F. As a result of this operation, the cleaning blade 16A is alternately attached to and separated from the photosensitive drum 11.

Figure 3:
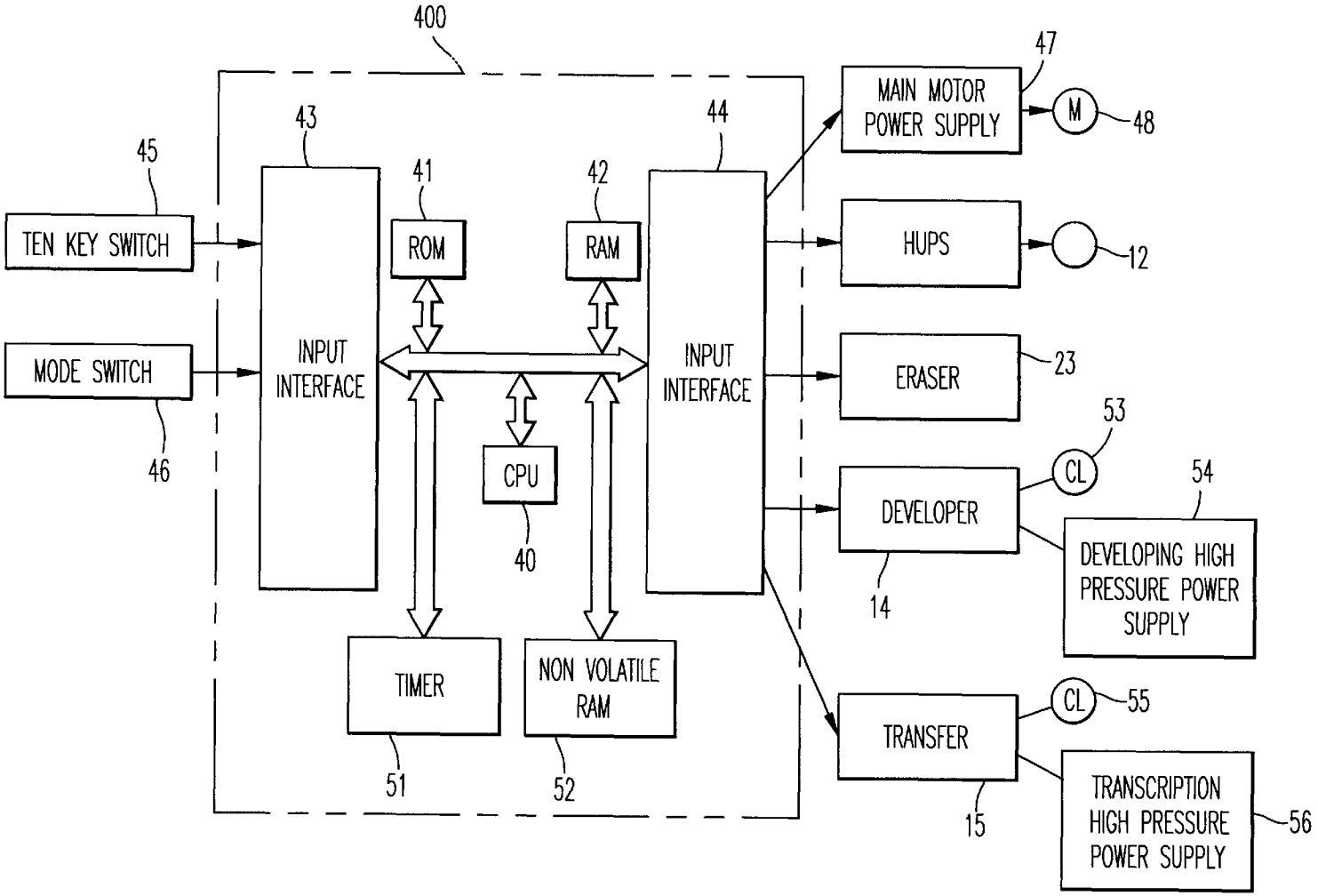
FIG. 3 is a block diagram according to an embodiment of the present invention.

FIG. 3 shows a block diagram according to the embodiments of the present invention. A main controller 400 includes a CPU 40 for handling all the signals of the system, a ROM 41 for storing programs run by the CPU 40, a RAM 42 utilized as a work area, an input interface 43, an output interface 44, a timer 51, and a non-volatile RAM 52 which maintains data even if a main power supply is turned off.

Setting signals from a ten key switch 45 or mode switch 46 established in an operation board of the main body of the copy machine are taken in the CPU 40 through the input interface 43, and a copying condition in accordance with such signals, such as a selected mode and a selected number of copy sheets, is recognized by CPU 40. The CPU 40 sends control signals concerned with the toner image formed on the photosensitive drum 11 or transferred to the transfer paper T to a power supply 47 of the main motor 48, a high pressure power supply 49 of the charging roller 12, the discharge lamp 23, the developer 14 and the transfer device 15. In a case of the second embodiment as shown in FIG. 2, the control signals are sent to the solenoid 16F to move the cleaning blade 16A.

Figure 4:
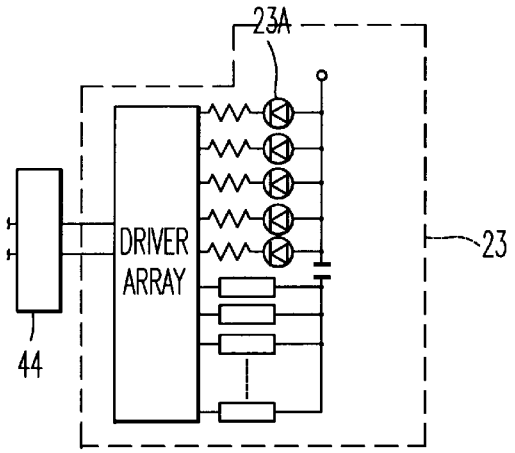
FIG. 4 is a schematic circuit diagram of a discharging lamp of the present invention.

As shown in FIG. 4, the discharge lamp 23 includes several LEDs 23A that are arranged in an axis direction of the photosensitive drum 11 to take on a so-called LED array structure. Each LED 23 comes on to light a predetermined area on the photosensitive drum 11. Accordingly, as to control data concerned with lighting of the LEDs 23A to the output interface 44, it is possible to control an adhesion pattern of toner onto the photosensitive drum 11.

The developer 14 includes a developing sleeve 14A, a developing clutch (CL) 53 for rotating the developing sleeve 14A, and a developing high pressure power supply 54 for applying a developing bias to the developing sleeve 14A, see FIG. 3. The transfer device 15 includes a transfer belt clutch (CL) 55 for moving the transfer belt 15A to be in contact with and to separate from the photosensitive drum 11 and a transcription high pressure power supply 56 for applying a transcription bias to a bias roller 16B in order to give electrical charge to the transfer belt 15A.

The present invention includes an operation of determining a summation of a moving time of the photosensitive drum 11 to control the supply of a lubricant, e.g. toner. That is, one feature of the present invention is recording the amount of time that photosensitive drum 11 is driven, and controlling the supply of a lubricant, e.g. toner, based on this recorded time. The summation of the moving time of the photosensitive drum 11 is achieved by the following procedure. An interrupt signal is input in an interrupting terminal of the CPU 40 at established intervals by the timer 51, and time data is counted and added up at every interruption in the CPU 40, and the data is then stored in a predetermined area of the RAM 42 or non-volatile RAM 52. In this embodiment, the time data is not counted up without reservation but under the stipulation that the main motor power supply 47 is turned on and a port of the output interface 44 for moving the main motor 48 (for rotating the photosensitive drum 11) is in an active condition.

Figure 5:
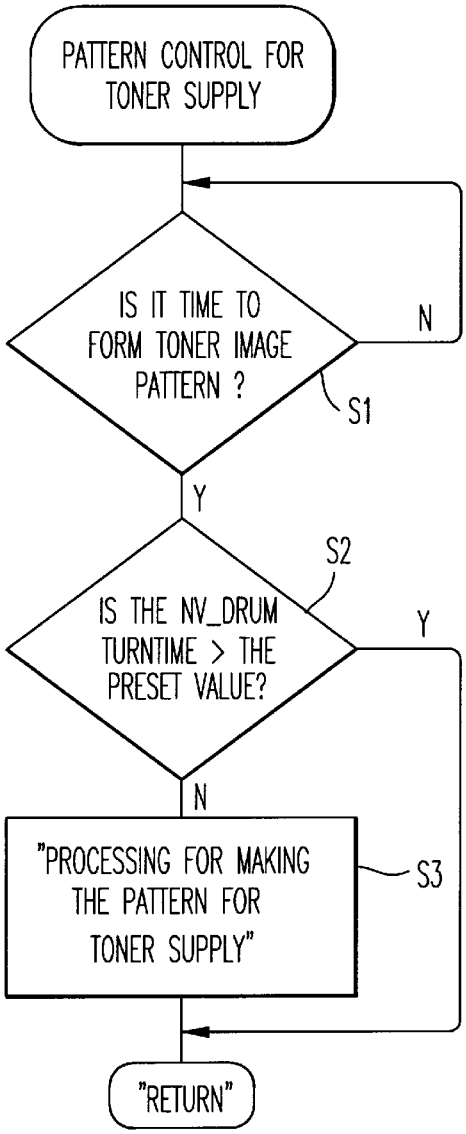
FIG. 5 is a flowchart of a toner supply control of an image forming device of the present invention.

FIG. 5 is a flowchart of a toner supply control of the image forming device of the present invention. In FIG. 5, it is judged whether a timing to form a toner image pattern to supply toner as a lubricant to the contact portion of the cleaning blade 16A and photosensitive drum 11 (at step S1) has been reached. The added up data of the photosensitive drum 11 stored in variable "NV_drum turn time" at the non-volatile RAM 52 is compared with a preset value to determine a timing to prohibit supplying toner (at step S2). When the added up data exceeds the preset value, a process for supplying toner to the contact portion of the cleaning blade 16A (step S3) is stopped.

It is also possible to store the above-mentioned preset value in the ROM 41. Furthermore, the above-mentioned preset value can be stored to be able to be rewritable in the non-volatile RAM 52 by a service technician. The judgement at step S1 "Is it a timing to form a toner pattern?" for supplying toner can, for example, be executed at an area of a toner pattern made on the photosensitive drum 11 at a non-image area provided between a first paper and a next paper transported, or at an area provided just after a last paper transported of a copying process.

Figure 6:
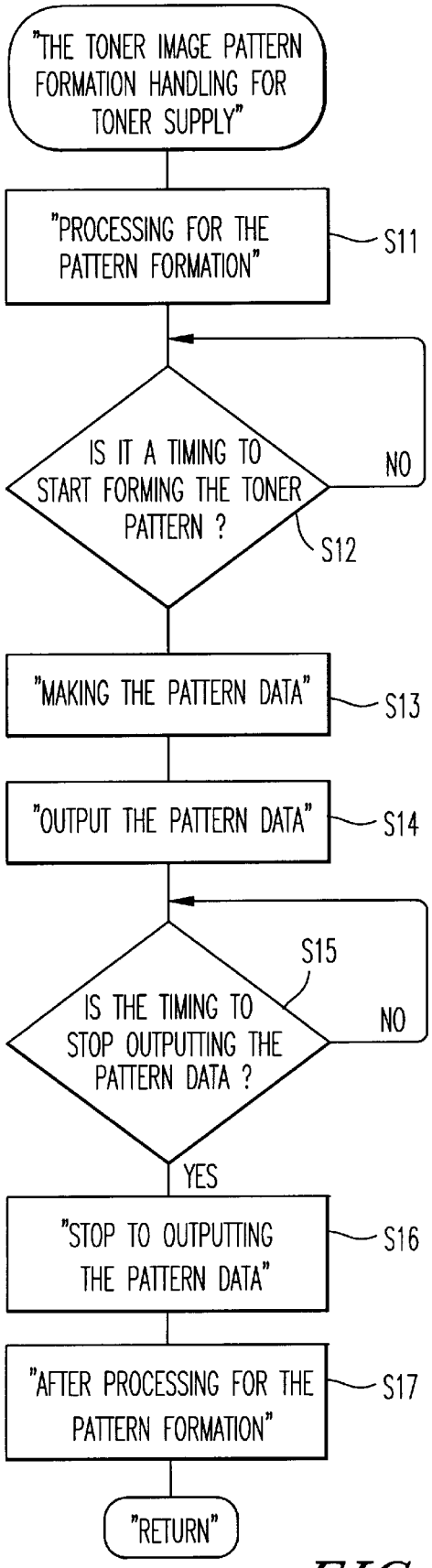
FIG. 6 is a flowchart of a pattern making process in a toner supply control of the present invention.

FIG. 6 is a flowchart showing a case of a toner image pattern formation handling for toner supply of the step S3 in FIG. 5. FIG. 6 shows an example of forming a toner image pattern by the discharge lamp 23. As a preprocessing for the pattern formation at step S11 in FIG. 6, a charging bias voltage is applied to the charging roller 12 and a developing bias voltage is applied to the developing sleeve 14A in the developer 14, and an ON-process of the developing clutch for turning the developing sleeve 14A is executed. As an after-processing, an OFF-processing can then be executed, e.g., of an actuator.

In steps S12 to S16 in FIG. 6, a toner image pattern is formed on the photosensitive drum 11 by the discharge lamp 23. An ON/OFF timing signal for forming the toner pattern by the discharge lamp 23 is generated at steps S12 and S15, and the pattern data determined at step S13 from an ON timing at step S12 to an OFF timing at step S15 is input to the output interface 44, and the discharge lamp 23 is lighted up by reason of the input pattern data. As a result, a toner image pattern handled by the above-mentioned steps is formed on the photosensitive drum 11.

Figure 7:
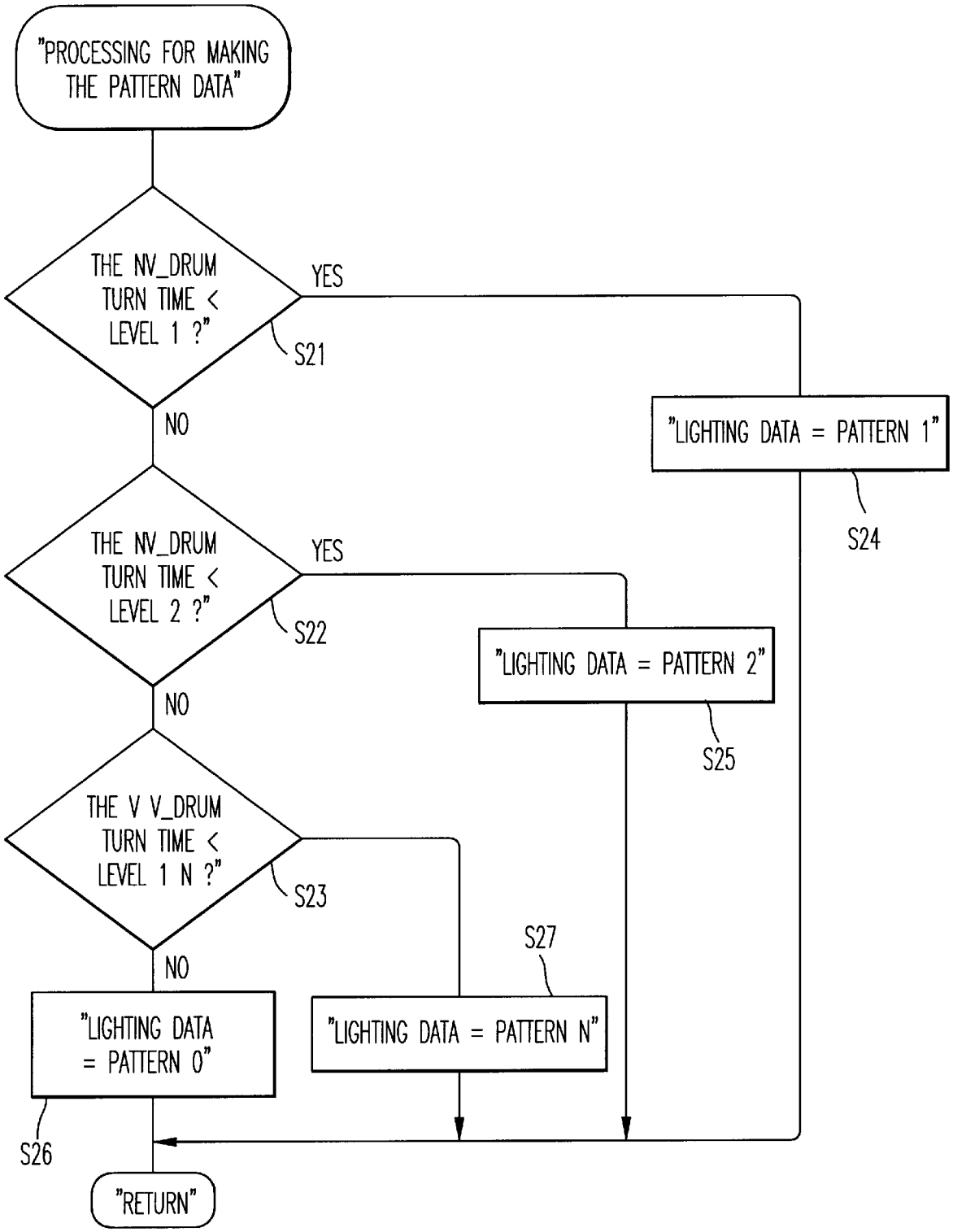
FIG. 7 is flowchart of a pattern data making process in a toner supply control of the present invention.

FIG. 7 is a flowchart of the lighting pattern data making process in step S13 in FIG. 6. Steps through S21 to S23 show a judgement process to change the lighting pattern data by the added up value of the driving time of the photosensitive drum 11. A time data (level i) for changing the pattern data has a bearing on the following mathematical expression "level i<level i+1". Accordingly, it is possible to change the lighting pattern data based on the added up value of the driving time of the photosensitive drum 11 through steps S24 to S27. As a result of the output of this pattern data to the output interface 44 and lighting the discharge lamp 23 corresponding to the pattern data, the toner image pattern is formed on the photosensitive drum 11. It may be desirable to gradually change the toner image pattern to gradually decrease the supply of toner as a lubricant, and to be changed to become nothing, or to put it another way, the toner pattern is eventually not formed at all.

In this embodiment, an ON/OFF action of the discharge lamp 23 for forming the toner image pattern for toner supply, or the shape of the toner image pattern for toner supply, is controlled based on the added up value of the driving time of the photosensitive drum 11, and undesired toner as a lubricant is not supplied to the contact portion formed between the cleaning blade 16A and the photosensitive drum 11, and it is, furthermore, possible to decrease the toner scattering caused by a deteriorated photosensitive drum 11 by friction. It is also possible to prevent a decrease in performance of the cleaning blade 16A caused by unsuitable toner supply as a lubricant in time-deterioration. It is also possible to prevent winding up of the cleaning blade at an early stage.

In this embodiment, by adding up a value of the driving time of the photosensitive drum 11, it is possible to grasp a rubbing time (degree of the friction) of the cleaning blade 16A and the photosensitive drum 11 more accurately in comparison with a case in which a control is based on a number of rotations of the photosensitive drum 11. Accordingly, toner scattering caused by a deteriorated photosensitive drum 11 by friction can be reduced more surely. Especially, it is possible to grasp a rubbing time (degree of the friction) of the cleaning blade 16A and the photosensitive drum 11 without depending on a length between a transfer paper and a next transfer paper, and it is possible to grasp the time in consideration of a contact condition of the cleaning blade 16A and the photosensitive drum 11 in the implementation of various adjustment modes for image controlling except for the image formation movement.

Furthermore, the added up value of the driving time of the photosensitive drum 11 can be stored in the non-volatile RAM 52 of the main control department 400, and usually that is an object of a fixed period maintenance, and the data in the RAM 52 is managed. Accordingly, the reliability of the data becomes high comparatively. Even though the photosensitive drum 11 is changed in some defectiveness, as the data is cleared by a serviceman, it is possible to grasp a rubbing time (degree of the friction) of the cleaning blade 16A and the photosensitive drum 11 and it is also possible to prevent the cleaning blade 16A to be wound up to thereby prevent toner scattering.

The toner image pattern for toner supply can be formed over a full longitudinal length of the photosensitive drum 11. However, it is acceptable to form the toner image pattern at only edges on the photosensitive drum 11, or at a non-image area located outside of the area of a transcription paper, because the cleaning blade 16A is usually wound up at the edges thereof.

Figure 8:
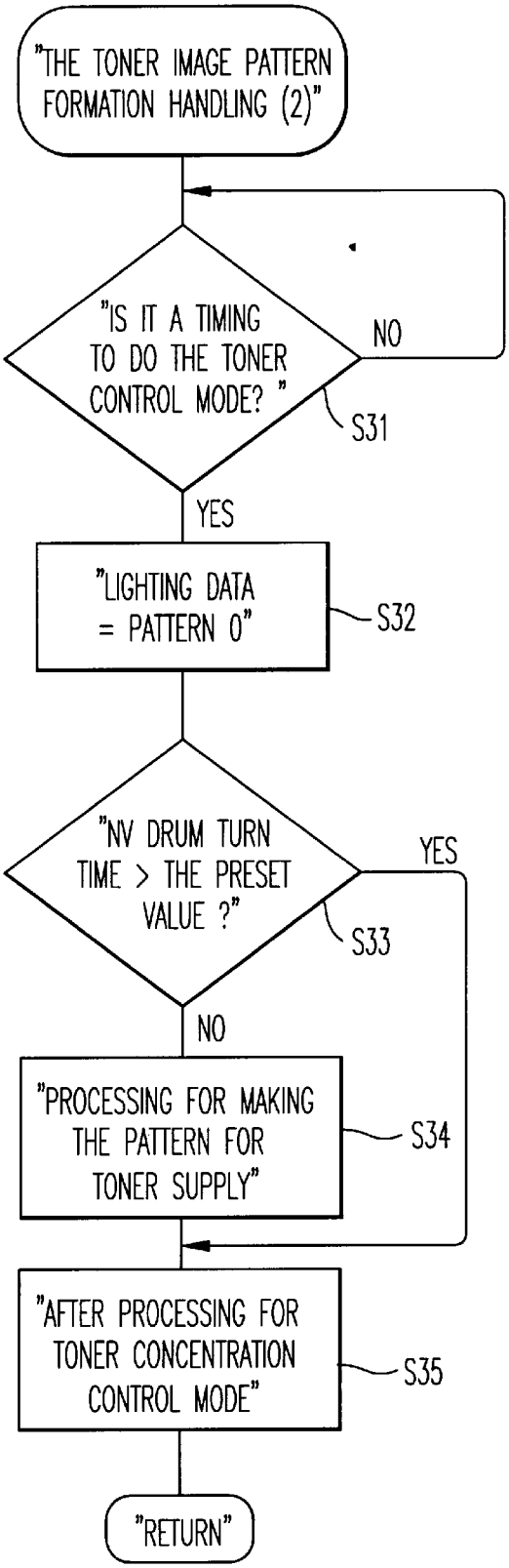
FIG. 8 is a flowchart of a pattern making process in a toner supply control according to a further embodiment of the present invention.
Figure 9A:
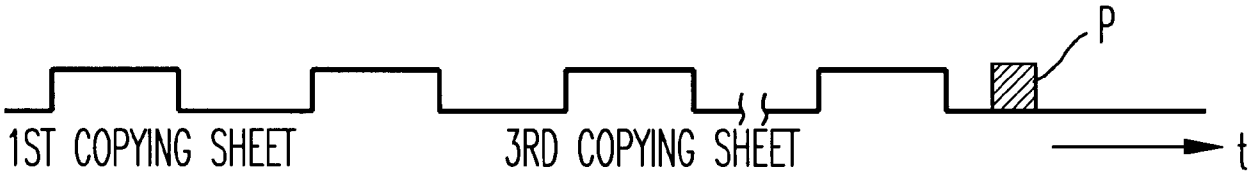
FIGS. 9 (*a*) and 9(*b*) are time charts showing time examples of toner image pattern formation for a toner concentration control according to the present invention.
Figure 9B:
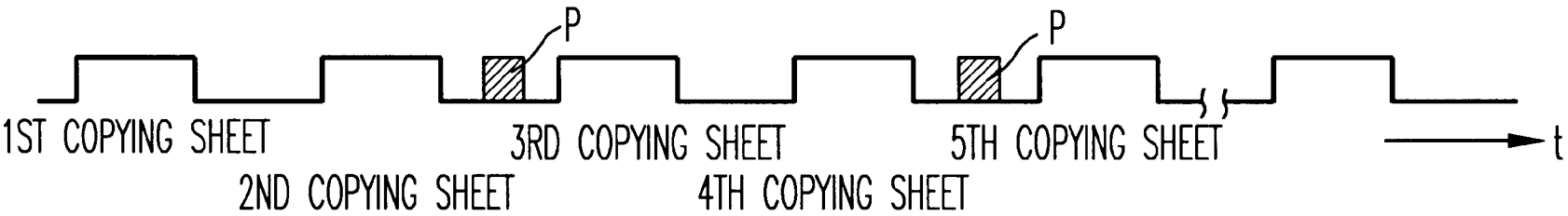

As shown in FIG. 8, it may be acceptable to synchronize the toner image pattern formation with the formation of a toner image pattern for toner concentration control. In FIG. 8, a start of formation of the toner image pattern for toner concentration control is checked. FIGS. 9 (*a*) and 9(*b*) are time charts showing time examples of toner image pattern formation for toner concentration control. The toner image pattern is formed at a marking "P" in FIGS. 9.

The toner image pattern for toner concentration control is formed after image formation for a predetermined number of sheets, for example 10, and the job is finished in FIG. 9(*a*). On the other hand, in FIG. 9(*b*), the toner image pattern for toner concentration control is formed between paper sheets every predetermined number of sheets during one job of image formation. Steps S33 and S34 provide the same control as steps S2 and S3 in FIG. 5, and the toner image pattern formation for toner concentration control is synchronized with the toner image pattern formation for toner supply as a lubricant. Steps S32 and S35 are before and after processing for toner concentration control. In step S32, a charging bias voltage is applied to the charging roller 12 and a developing bias voltage is applied to the developing sleeve 14A in the developer 14, and an ON-process of the developing clutch 53 for a turn of the developing sleeve 14A is executed. In step S35, an OFF-process for an actuator which was actuated in the step S32 is executed.

In a toner concentration control mode, a toner image density in a toner concentration pattern formed for toner concentration control on the photosensitive drum 11 is detected by an optical sensor. Based on a result of the data detected by this sensor, toner supplying in an image formation of a next fixed number of sheets is controlled. For example, as an output voltage of the sensor becomes small pursuant to the image density of the toner concentration pattern for toner concentration control becoming dense, when the output voltage of the sensor is greater than the fixed control standard value, it is judged that toner concentration in the developer is lower than a fixed standard value, and a prescribed amount of toner is supplied in each image formation movement to a next toner concentration pattern formation. On the other hand, when the output voltage of the sensor is less than the fixed control standard value, it is judged that toner concentration in the developer is higher than the fixed standard value, and toner is not supplied.

To execute the flowchart in FIG. 8, as the toner image pattern for toner supply is formed matching the formation of the toner image pattern for toner concentration, the image pattern for toner supply is formed with a small change of the image pattern for toner concentration. Accordingly, each sequential control for forming toner image pattern, may not be required, and thus the control program can be easily constructed.

Figure 10A:
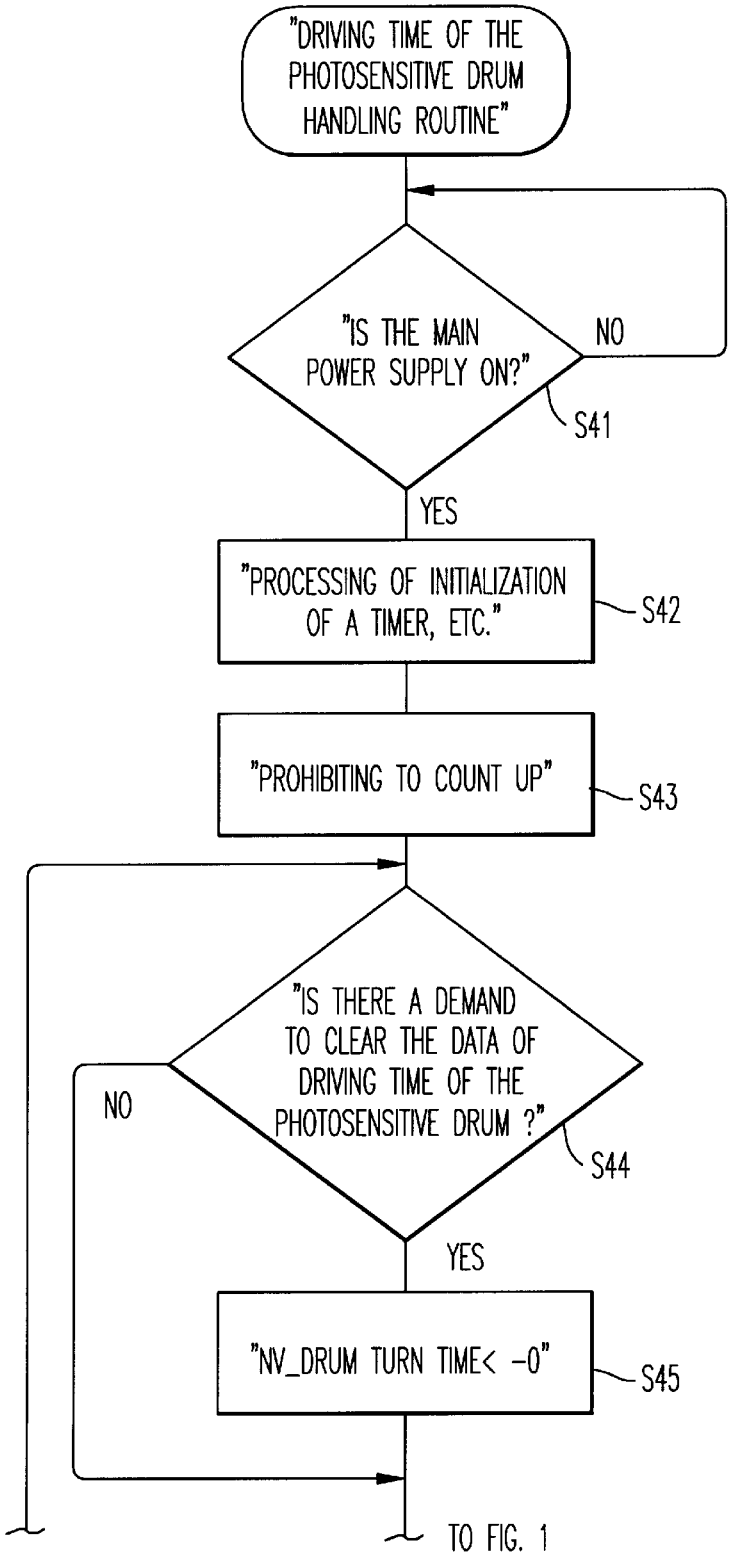
FIG. 10 is a flowchart of a pattern making process in a toner supply control according to a modified embodiment of the present invention.
Figure 10B:
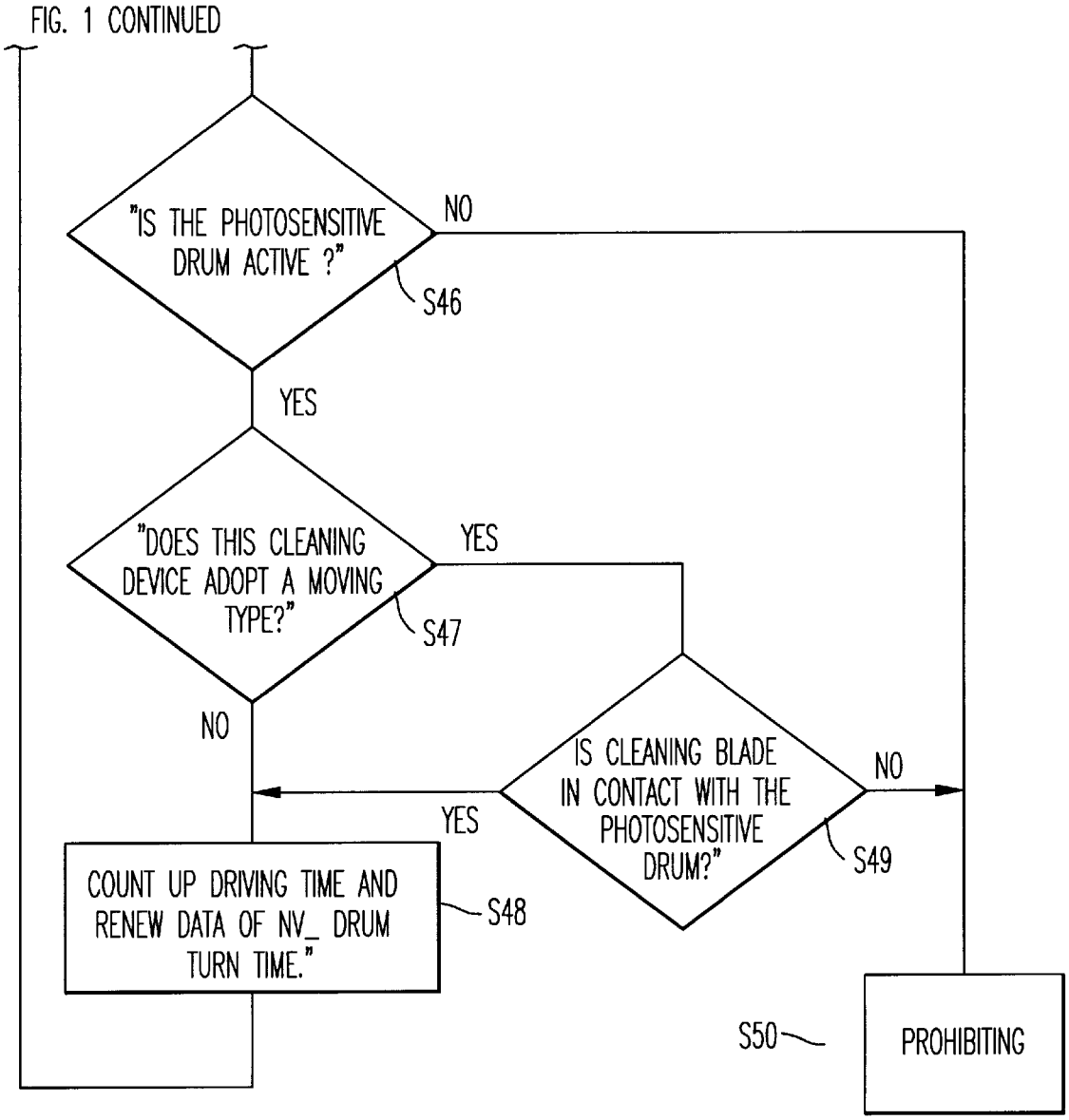

By including the blade moving device, shown in FIG. 3, that moves the cleaning blade 16A away from the contact portion provisionally, as shown in FIG. 10, it is desirable to count up only while the cleaning blade 16A is in contact with the surface of the photosensitive drum 11. In FIG. 10, it is recognized whether the main power supply is turned on, and counting up is prohibited after initialization of the timer 51 and related objects with the timer 51 (steps S41 to S43). In the next step S44, it is judged whether there is a demand to clear a variable contents (NV_drum turn time) in non-volatile RAM 52 where the added up value of driving time of the photosensitive drum 11 is stored. When there is the demand to clear the data, the NV_drum turn time is cleared in step S45. When there is no such demand, the process proceeds to step S46. These steps S44 and S45 are control flows for periodical maintenance of the photosensitive drum 11, and based on clear demand data input in exchange of the photosensitive drum 11 by a serviceman, the NV_drum turn time is cleared.

Next, a movement of the photosensitive drum 11 is judged in step S46. When the photosensitive drum 11 is active, YES in step S46, then whether the moving type of the cleaning device is adopted or not is judged in step S47. When it has judged that the moving type of the cleaning device is not adopted, the driving time is counted up, and the data of the NV_drum turn time in non volatile RAM 52 is renewed (step S48).

On the other hand, when it has judged that the moving type of the cleaning device is adopted, judgment whether the cleaning blade 16A is in contact with the photosensitive drum 11 or not is executed (step S49). When the cleaning blade 16A is in contact with the photosensitive drum 11, the driving time is counted up and the data of the NV_drum turn time in non-volatile RAM 52 is renewed (step S48). When it is judged that the photosensitive drum 11 is not active at step S46, or when it is judged the cleaning blade 16A is not in contact with the photosensitive drum 11 at step S49, the time counted up by the timer 51 is prohibited.

In this embodiment, as a driving time of the photosensitive drum 11 is counted up only when the cleaning blade 16A is in contact with the photosensitive drum 11 by the blade moving device, a time (degree of the friction) when the cleaning blade 16A is actually in contact with the drum 11 is grasped accurately. Accordingly, it is possible to prevent the toner scattering in time-varied with reliability.

The above mentioned embodiments are explained in a case of an image forming device such as a copy machine. This invention can clearly be applied to other image forming apparatuses, such as of a printer and so on. Furthermore, in the explained embodiments toner is supplied as a lubricant, but it is acceptable to supply a lubricant other than toner up to the contact portion of the photosensitive drum 11 and the cleaning blade 16A by reason of an added up value of a driving time of the photosensitive drum 11.

Obviously, numerous additional modifications and variations of the present invention are possible in light of the above teachings. It is therefore to be understood that within the scope of the appended claims, the present invention may be practiced otherwise than as specifically described herein.

The present application is based on Japanese Priority Document 08/353,664, the contents of which are incorporated herein by reference.

What is claimed as new and is desired to be secured by Letters Patent of the United States is:

1. An image forming apparatus having an image carrier, comprising:

a cleaning blade contacting said image carrier for removing residual toner from said image carrier;

a lubricant supplying means for supplying lubricant to a contact portion composed of said cleaning blade and said image carrier in order to decrease a coefficient of friction between said cleaning blade and said image carrier;

a calculating means for adding up a moving time of said image carrier; and a control means for regulating a supplying quantity of said lubricant by the lubricant supplying means based on a result of a sum of the moving time added up by said calculating means.

2. An image forming apparatus having an image carrier comprising:

a cleaning blade contacting said image carrier for removing residual toner from said image carrier;

a lubricant supplying means for supplying lubricant to a contact portion composed of said cleaning blade and said image carrier in order to decrease a coefficient of friction between said cleaning blade and said image carrier;

a calculating means for adding up a driving condition of said image carrier; and a control means for regulating a supplying quantity of said lubricant by the lubricant supplying means based on a result of a sum added up by said calculating means, wherein said control means regulates the supplying quantity of lubricant to be zero when the sum exceeds a predetermined value.

3. An image forming apparatus having a image carrier, comprising:

a cleaning blade contacting said image carrier for removing residual toner from said image carrier;

a lubricant supplying means for supplying lubricant to a contact portion composed of said cleaning blade and said image carrier in order to decrease a coefficient of friction between said cleaning blade and said image carrier;

a calculating means for adding up a driving condition of said image carrier; and a control means for regulating a supplying quantity of said lubricant by the lubricant supplying means based on a result of a sum added up by said calculating means, wherein said lubricant supplying means has an image pattern forming means for forming an image pattern for supplying lubricant to said contact portion on said image carrier, and said control means changes a forming condition of said image pattern based on the sum added up by said calculating means.

4. A image forming apparatus in accordance with claim 3, wherein said lubricant is toner used for development.

5. An image forming apparatus in accordance with claim 4, further comprising:

an image pattern forming means for forming an image pattern for toner concentration, and wherein said image pattern for toner as lubricant is formed in synchronization with the formation of said image pattern for toner concentration.

6. An image forming apparatus having an image carrier, comprising:

a cleaning blade contacting said image carrier for removing residual toner from said image carrier;

a lubricant supplying means for supplying lubricant to a contact portion composed of said cleaning blade and said image carrier in order to decrease a coefficient of friction between said cleaning blade and said image carrier;

a calculating means for adding up a driving condition of said image carrier;

a control means for regulating a supplying quantity of said lubricant by the lubricant supplying means based on a result of a sum added up by said calculating means; and a blade moving means for moving said cleaning blade at a location away from said image carrier, and wherein said calculating means adds up the driving condition of said image carrier only when said cleaning blade is in contact with said image carrier.

7. An image forming apparatus having an image carrier, comprising:

a cleaning blade contacting said image carrier for removing residual toner from said image carrier;

a lubricant tank for supplying lubricant to a contact portion composed of said cleaning blade and said image carrier in order to decrease a coefficient of friction between said cleaning blade and said image carrier;

a calculating circuit for adding up a moving time of said image carrier; and a controller for regulating a supplying quantity of said lubricant by the lubricant tank based on a result of a sum of the moving time added up by said calculating circuit.

8. An image forming apparatus having an image carrier, comprising:

a cleaning blade contacting said image carrier for removing residual toner from said image carrier;

a lubricant tank for supplying lubricant to a contact portion composed of said cleaning blade and said image carrier in order to decrease a coefficient of friction between said cleaning blade and said image carrier;

a calculating circuit for adding up a driving condition of said image carrier; and a controller for regulating a supplying quantity of said lubricant by the lubricant tank based on a result of a sum added up by said calculating circuit, wherein said controller regulates the supplying quantity of lubricant to be zero when the sum exceeds a predetermined value.

9. An image forming apparatus having an image carrier comprising:

a cleaning blade contacting said image carrier for removing residual toner from said image carrier;

a lubricant tank for supplying lubricant to a contact portion composed of said cleaning blade and said image carrier in order to decrease a coefficient of friction between said cleaning blade and said image carrier;

a calculating circuit for adding up a driving condition of said image carrier;

a controller for regulating a supplying quantity of said lubricant by the lubricant tank based on a result of a sum added up by said calculating circuit; and a discharge lamp for forming an image pattern for supplying the lubricant to said contact portion on said image carrier, and said controller changes a forming condition of said image pattern based on the sum added up by said calculating circuit.

10. A image forming apparatus in accordance with claim 9, wherein said lubricant is toner used for development.

11. An image forming apparatus in accordance with claim 10, wherein the discharge lamp further forms an image pattern for toner concentration, and wherein said image pattern for supplying the lubricant is formed in synchronization with the formation of said image pattern for toner concentration.

12. An image forming apparatus having an image carrier, comprising:

a cleaning blade contacting said image carrier for removing residual toner from said image carrier;

a lubricant tank for supplying lubricant to a contact portion composed of said cleaning blade and said image carrier in order to decrease a coefficient of friction between said cleaning blade and said image carrier;

a calculating circuit for adding up a driving condition of said image carrier;

a controller for regulating a supplying quantity of said lubricant by the lubricant tank based on a result of a sum added up by said calculating circuit; and an actuator for moving said cleaning blade at a location away from said image carrier, wherein said calculating circuit adds up a driving condition of said image carrier only when said cleaning blade is in contact with said image carrier.

* * * * *